United States Patent [19]

Lang

[11] Patent Number: 4,561,756

[45] Date of Patent: Dec. 31, 1985

[54] SHORT PAPER PATH COPY SHEET TRANSPORT SYSTEM

[75] Inventor: Joseph H. Lang, Webster, N.Y.

[73] Assignee: Xerox Corporation, Stamford, Conn.

[21] Appl. No.: 681,355

[22] Filed: Dec. 13, 1984

[51] Int. Cl.[4] ..... G03G 15/00

[52] U.S. Cl. ..... 355/3 SH; 355/3 TR; 355/3 CH; 355/14 CH; 355/14 TR

[58] Field of Search ..... 355/3 SH, 3 CH, 3 TR, 355/14 SH, 14 CH, 3 R, 3 FU, 14 FU

[56] References Cited

U.S. PATENT DOCUMENTS

| | | | |
|---|---|---|---|
| 3,508,824 | 4/1970 | Leinbach et al. | 355/3 |
| 3,601,392 | 8/1971 | Spear, Jr. et al. | 271/53 |
| 3,774,907 | 11/1973 | Borostyan | 271/80 |
| 3,794,417 | 2/1974 | Machmer | 355/3 |
| 3,863,913 | 2/1975 | Hirafuji | 271/265 |
| 3,882,744 | 5/1975 | McCarroll | 83/262 |
| 3,949,979 | 4/1976 | Taylor et al. | 271/10 |
| 3,963,339 | 6/1976 | Taylor et al. | 355/3 R |
| 4,017,067 | 4/1977 | Soures et al. | 271/80 |
| 4,025,187 | 5/1977 | Taylor et al. | 355/14 |
| 4,058,306 | 11/1977 | Fletcher | 271/80 |
| 4,092,021 | 5/1978 | Fletcher | 271/176 |
| 4,338,017 | 7/1982 | Nishikawa | 355/3 TR |
| 4,355,881 | 10/1982 | Tarumi et al. | 355/3 FU |
| 4,372,669 | 2/1983 | Fantuzzo et al. | 355/3 R |
| 4,396,273 | 8/1983 | Matsuyama et al. | 355/3 TR |

*Primary Examiner*—A. C. Prescott

*Attorney, Agent, or Firm*—William A. Henry, II

[57] ABSTRACT

In a copier wherein the fuser rolls are positioned closer than the dimensions of the copy sheet from the image transfer area, speed mismatch compensation between the fuser roll nip and the initial image support surface is provided by intentionally driving the fuser roll nip at a different pre-set velocity to form a buckle in the intermediate portion of the copy sheet. The buckle is controlled by a baffle arrangement which allows the buckle to develop in the copy sheet prior to entering the fuser. The buckle is used to absorb the speed mismatch between the initial image support surface and the fuser and thereby prevent smearing of the unfused image on the copy sheet.

12 Claims, 5 Drawing Figures

SHORT PAPER PATH COPY SHEET TRANSPORT SYSTEM

BACKGROUND OF THE INVENTION

This invention relates to a means for transporting a copy sheet from the transfer station to the fuser station of a copying machine. More particularly, it relates to a short paper path configuration within a copier in which copy paper is simultaneously subjected to both transfer and fusing of an image.

In a transfer electrostatographic process such as conventional transfer xerography, in which an image pattern of dry particulate unfused toner material is transfered to a final image support surface, e.g., a copy sheet from an initial image bearing surface, e.g., a charged photoreceptor surface developed with toner, the transferred toner is typically only loosely adhered to the final support surface after transfer, and is easily disturbed by the process of stripping the final support surface away from the initial support surface and by the process of transporting the final support surface to the toner fusing station. The final support surface preferably passes through a fusing station as soon as possible after transfer so as to permanently fuse the toner image to the final support surface, thereby preventing smearing or disturbance of the toner image by mechanical agitation or electrical fields. For this reason, and also for reasons of simplifying and shortening the paper path of the copier and space savings, it is desirable to maintain the fusing station as close as possible to the transfer station. A particularly desirable fusing station is a roll type fuser, wherein the copy sheet is passed through a pressure nip between two rollers, preferably at least one of which is heated and at least one of which is resilient.

However, when such a fuser roll nip for the final support surface is located close enough to the transfer station so that a lead portion of the final support surface can be in the fuser roll nip simultaneously with the rear or trailing portion of that same final support surface still being in contact with the photoreceptor, then a serious problem can arise, to which the present invention provides a solution. This problem is that of smears or skips in the unfused toner image which has been, or is being, transferred to the trailing portion of the final support surface. This condition is caused by relative movement or slippage between the initial support surface and the final support surface in those areas where they are still in contact, i.e., those areas of the final support surface which have not yet been stripped away from the initial support surface. A source of such slippage is a speed mismatch between the nip speed of the fuser rolls (the speed at which the fuser is pulling the lead edge of the paper through the fuser) relative to the surface speed of the initial support surface. If the fuser roll nip speed is slower, the final support can slip backwards relative to the initial image support surface. If the fuser roll is faster, the final support material can be pulled forward relative to the image on the initial support surface. In either case this can cause the aforementioned smears or skips in the toner image being transferred to the trailing edge of the final support, or image elongation.

An exactly equal velocity drive connection between the initial support surface and the fuser rolls is difficult to maintain. Also, there is a further complication that the actual sheet driving velocity of the fuser roll nip can change with changes in the effective diameter of the driving roll in the nip. This can occur from replacement of the rollers, or changes in the resilient deformation of the rollers due to changes in the applied nip pressure, materials aging, temperature effects, etc. In addition, paper of different thicknesses travel through a fuser at different speeds. Thus, equal speed is difficult to maintain between the fuser roll nip and the photorecepter surface in a commercial apparatus and may require increased maintenance and speed adjustment mechanisms.

Where the spacing between the fusing station and the transfer station is greater than the dimensions of the copy sheet, and a separate two-speed sheet transport is provided therebetween, then substantially different fuser roll nip speeds can be provided, as in U.S. Pat. No. 3,794,417, issued Feb. 26, 1974, to J. A. Machmer. However, this has the noted disadvantages of requiring additional space, increased unfused image sheet handling, and also the additional complexity and expense of the additional transport mechanism.

It is known in the electrostatographic copying art to form a buckle in a copy sheet in its movement through the copier at other locations and for other functions. For example, it is known to interrupt the forward movement of a copy sheet with registration fingers and to form a buckle in the copy sheet by its continued feeding by upstream feed rollers to provide registration of the lead edge of the copy sheet before the copy sheet is fed into the image transfer station, e.g., U.S. Pat. No. 3,601,392, issued Aug. 24, 1971, to Merton R. Spear, Jr., et al. It is also known to provide for pre-form a buckle in a web of copy material to compensate for the braking of the web during a cutting operation in which the web is cut into individual sheets, e.g., U.S. Pat. No. 3,882,744, issued May 13, 1975, to Alan F. McCarroll. The later patent also illustrates that the copy web may be pre-formed into an initial convex buckle over an apertured surface and that air pressure may be utilized to expand the buckle when the web is stopped downstream thereof.

U.S. Pat. No. 3,774,907, issued Nov. 27, 1973, to Stephen Borostyan illustrates a vacuum sheet stripping device for removing copy sheets from the initial image support member and advancing them to a roll fuser, wherein the copy sheets assume a convex shape. A rotating cylindrical apertured vacuum member is utilized, to which the copy sheet is attracted. During a portion of its rotation, the vacuum is automatically cutoff to the vacuum stripping member to release the copy sheet.

U.S. Pat. No. 3,508,824, issued Apr. 18, 1970, to R. K. Leinback et al. describes a conductive curved guide plate for attracting a copy sheet at the stripping area and guiding it towards a fusing station.

The present invention provides a speed mismatch compensation system which allows the fusing roll nip to be closely spaced from the transfer station of a printer or copier, by a distance less than the movement dimension of an individual copy sheet, to provide the above-stated advantages of such a system, yet overcome or substantially reduce the above-stated disadvantages thereof. The intermediate portion of the copy sheet is selectively supported and guided in a series of critically positioned baffles and guides which accommodate a speed differential between the fuser roll nip velocity and the velocity of the initial image support surface. A speed variation and differential is accommodated between the leading edge and trailing edge areas of the same final image support surface, in a manner which avoids disturbance of the unfused toner image in any area thereon.

Further objects, features, and advantages of the present invention pertain to the particular apparatus, steps, and details whereby the above-mentioned aspects of the invention are attained. Accordingly, the invention will be better understood by reference to the following description of an exemplary embodiment thereof, and to the drawings forming a part of that description, which are approximately to scale, wherein.

Figure 1:
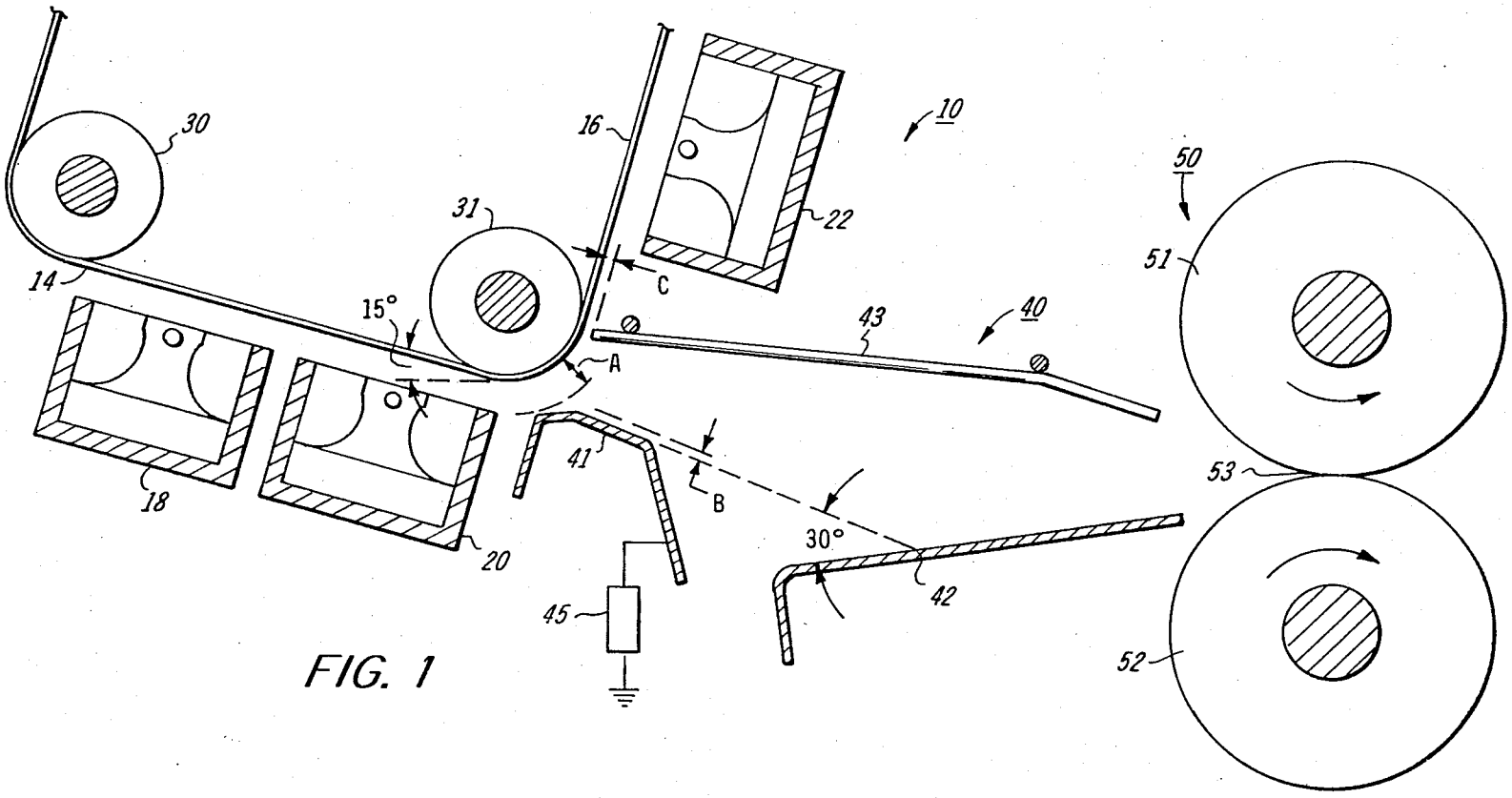
FIG. 1 is a cross-sectional partial side view of an exemplary copying apparaus in accordance with the present invention, illustrating those portions thereof relevant to the description of the present invention.

Referring now to the drawings, and specifically to the embodiment 10 of FIGS. 1–4, it may be seen that the xerographic transfer, stripping and roll fusing system illustrated therein is generally similar in many respects to commercially available xerographic copiers. Accordingly, the following description will be directed to the novel aspects of the embodiment providing the above-discussed speed mismatch compensation.

Figure 2:
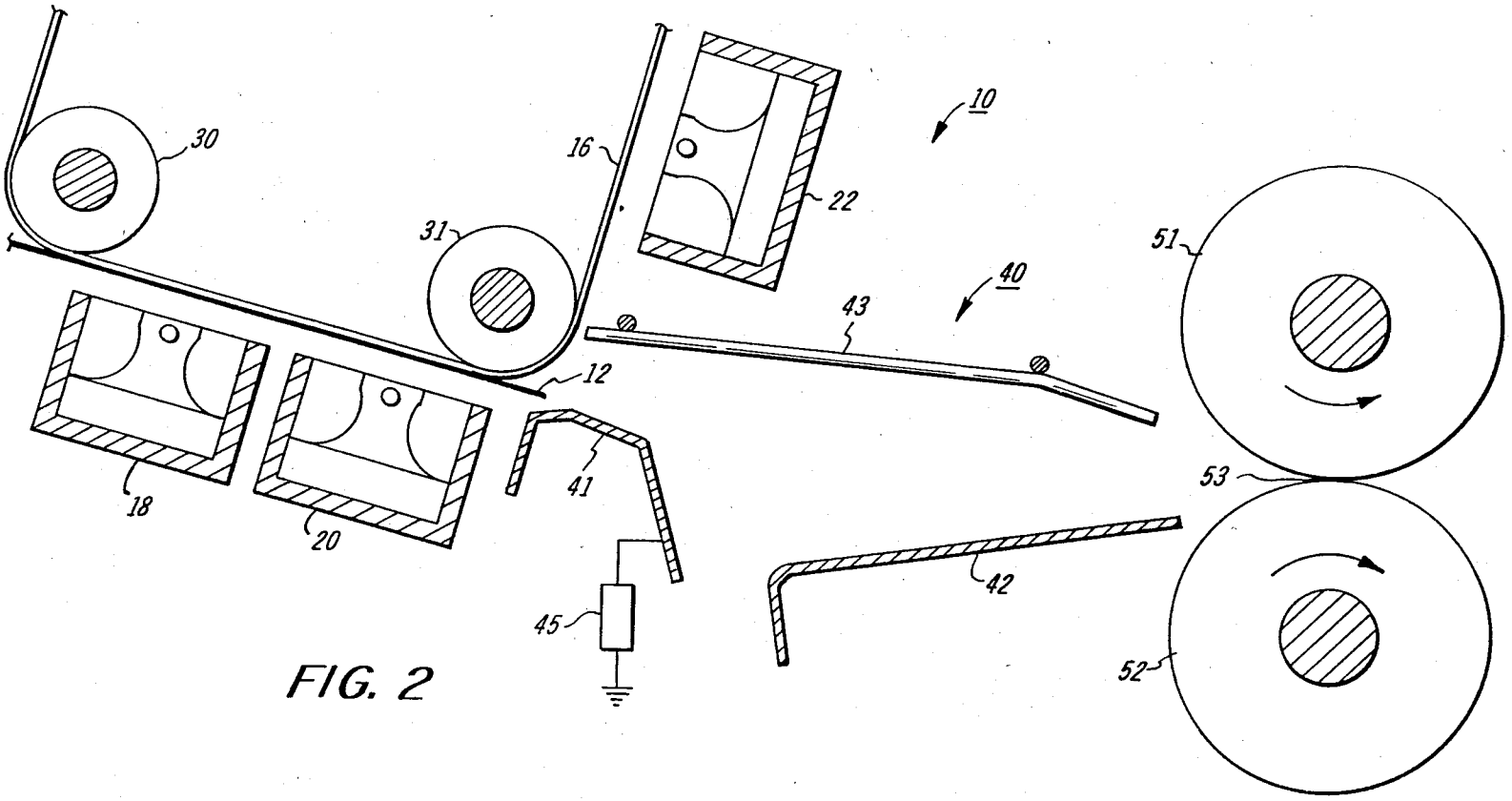
FIGS. 2–5 are cross-sectional views of the apparatus of the present invention indcating the action of paper as it is fed.
Figure 3:
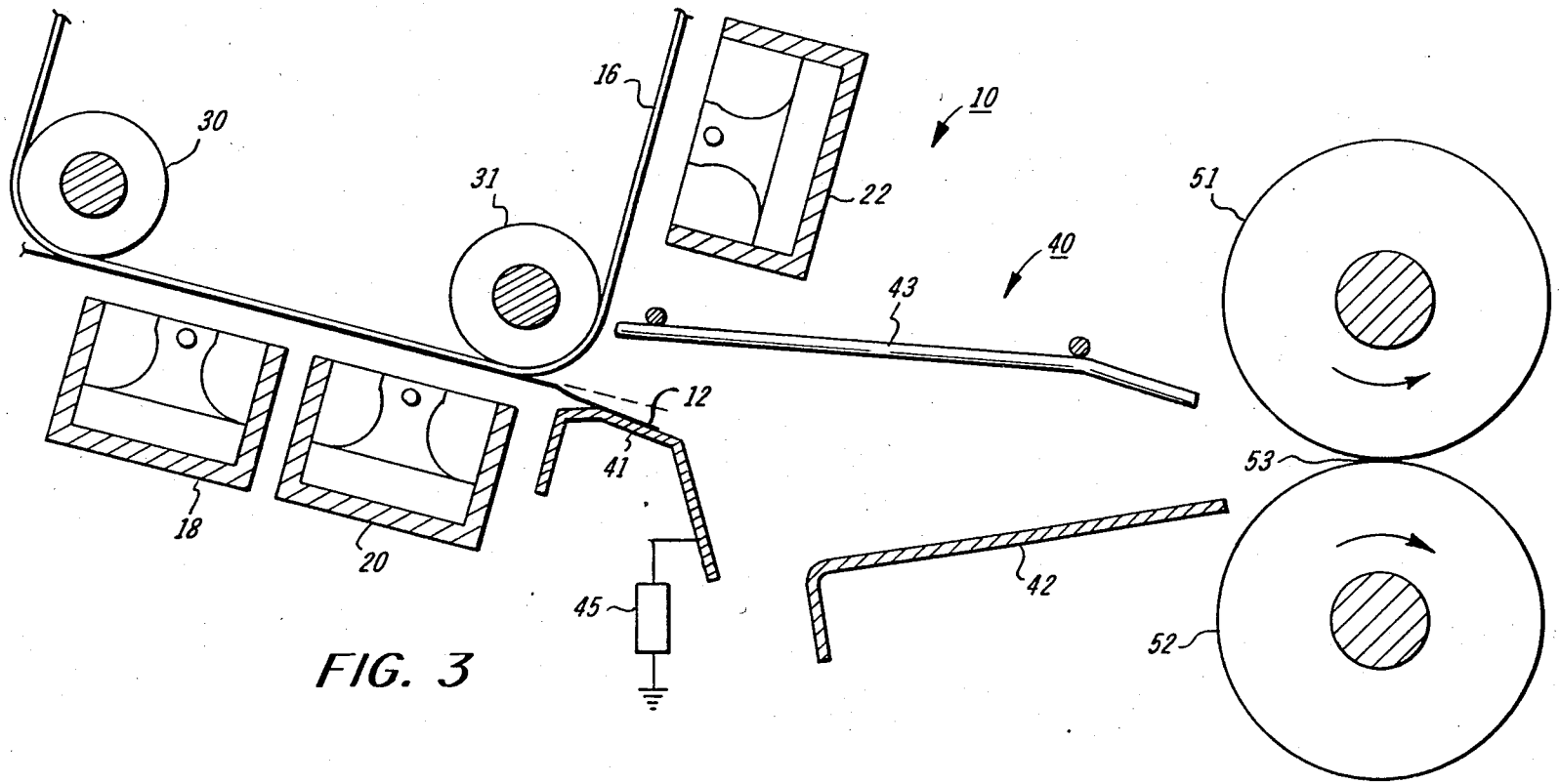

However, briefly describing the conventional aspects of the disclosed system 10, it may be seen that a copy sheet 12 as shown in FIG. 2 is sequentially brought into contact with, and transported at the same speed as, the image bearing surface 14 of a moving photoreceptor belt 16. The copy sheet 12 passes under a transfer corona generator 18, preferably a pin corotron, which applies electrostatic transfer charges to the back of a the sheet and electrostatically tacks the copy sheet against the surface of photoreceptor belt 16. The copy sheet is then transported on the photoreceptor 16 under a detacking corona geneator 20 which substantially reduces the charge thereon, preferably with a pin corotron. It should be understood that the detacking corona generator is optional. The lead edge of the copy sheet is then self stripped from photoreceptor belt 16 due to the sharp curvature given the belt by stripper roller 31, which preferably has a 0.75" diameter.

Turning now to the major areas of differences between the system 10 and prior systems of this type, an optimized multiple baffle arrangement and configuration is disclosed in FIGS. 1–4 and adapted such that an incoming sheet stripped from belt 16 by roll 31 always hits passive acquisition baffle first, then hits the bottom baffle 41, slides up the bottom baffle to fuser 50 and into the fuser nip formed between fuser roll 51 and backup roll 52 and matches the fuser nip speed by buckling into the passive baffle 41 and prefuser baffle 42. The baffle arrangement could be made of one piece if desired.

A conventional direct mechanical drive interconnection (not shown) is used to connect the axis of one of the fuser rolls and the axis of the drive roll 30 for photoreceptor belt 16. This drive interconnection is provided with a suitable difference pulley or gear diameters to provide a slightly slower speed for the fuser roll nip 53 than for the photoreceptor belt 16 in the transfer station. Thus, as the copy sheet 12 is advanced thrugh the fuser nip 53, the lead edge of the sheet is moving downstream at a slightly slower velocity than the intermediate and trailing areas of the same copy sheet are being advanced downstream by the photoreceptor belt 16. This would cause a potential force for slippage beteen the copy sheet 12 and belt 16, which would cause toner image smears or skips or elongation of the image except that the system 10 provides means to allow the intermediate portion of the copy sheet 12, between the fuser roll nip and the stripping roll, to form a buckle away from its imaged side and away from paper guide 42. The baffle arrangement is designed to allow the buckle of the sheet 12 to expand freely out to a maximum position to take up or absorb the full accumulated speed mismatch or differential of the entire copy sheet 12 until the trail edge of the copy sheet is removed from the photoreceptor. The buckle is always concave and expands further concavely as the copy sheet advances after having reached the fuser roll nip.

In reference to the novel baffle arrangement in FIG. 1, a sheet is stripped from photoreceptor 16 due to a detacking current from corotorn 20 and the sharp curve that the photoreceptor follows around stripping roll 31. In addition, the photoreceptor is mounted on drive roll 30 and stripper roll 31 at an angle of 15° with a line drawn horizontally and tangent to stripper roll 31. This positioning of the photoreceptor in addition to enhancing stripping, works in conjunction with the baffle arrangement 40 to provide a smooth nonsmear transition for a copy sheet from the transfer point on the photoreceptor through the fuser. More particularly, and in accordance with the present invention, after a sheet is stripped from the photoreceptor as shown in FIG. 2, it is attracted by passive acquisition baffle 41 from the position shown in dotted lines in FIG. 3 to provide paper and strip point control after stripping due to the attraction. The passive acquisition baffle is grounded and aids in stripping the sheet from the photoreceptor because it acts as a ground plane resulting in electrostatic attraction between paper with a charge density and the baffle. Also, a conductive metal or a dielectric baffle will work equally well in the present invention. The passive acquistion baffle is most effective when the paper charge is high (no detack) and dimensions A and B (shown in FIG. 1) are small. For example, most machine space constraints would limit dimension A to 7 mm and B to 2 mm. Dimension C is preferably 1.5 mm. Isolating the passive acquistion baffle from ground allows it to charge to the same polarity as the sheet passing thereover due to contact resulting in electrostatic repulsive forces between the paper and the baffle. The passive acquisition baffle is made from a polished austenitic stainless steel annealed sheet of 1 mm thickness. A high impedance member 56 is positioned between the passive acquisition baffle and ground in order to stop current leakage from the transfer corotron in high humidity environments. The high impedance member could be a zener diode, R.C. circuit, voltage source, resistor or any other suitable impedance means.

Figure 4:
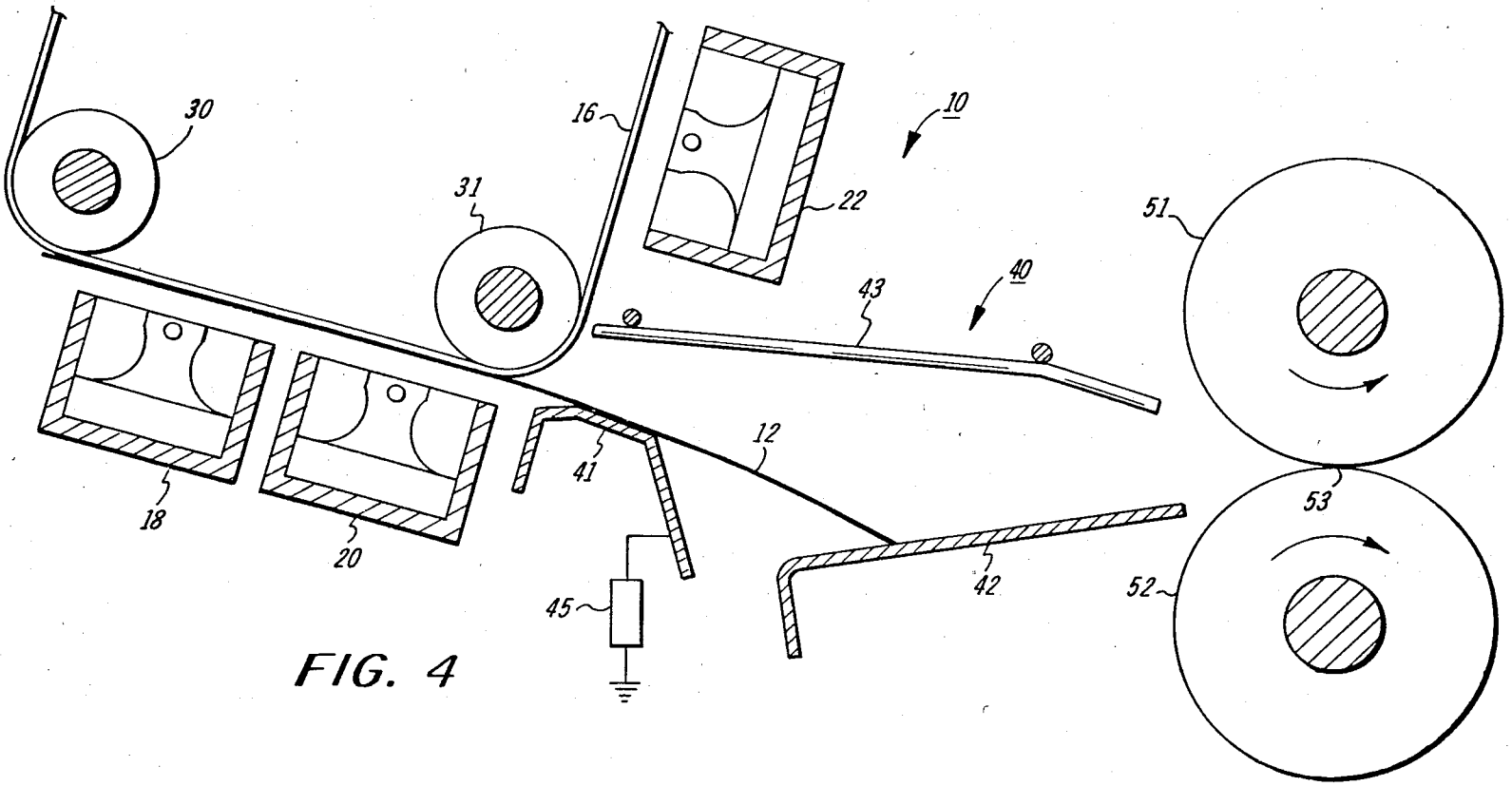
Figure 5:
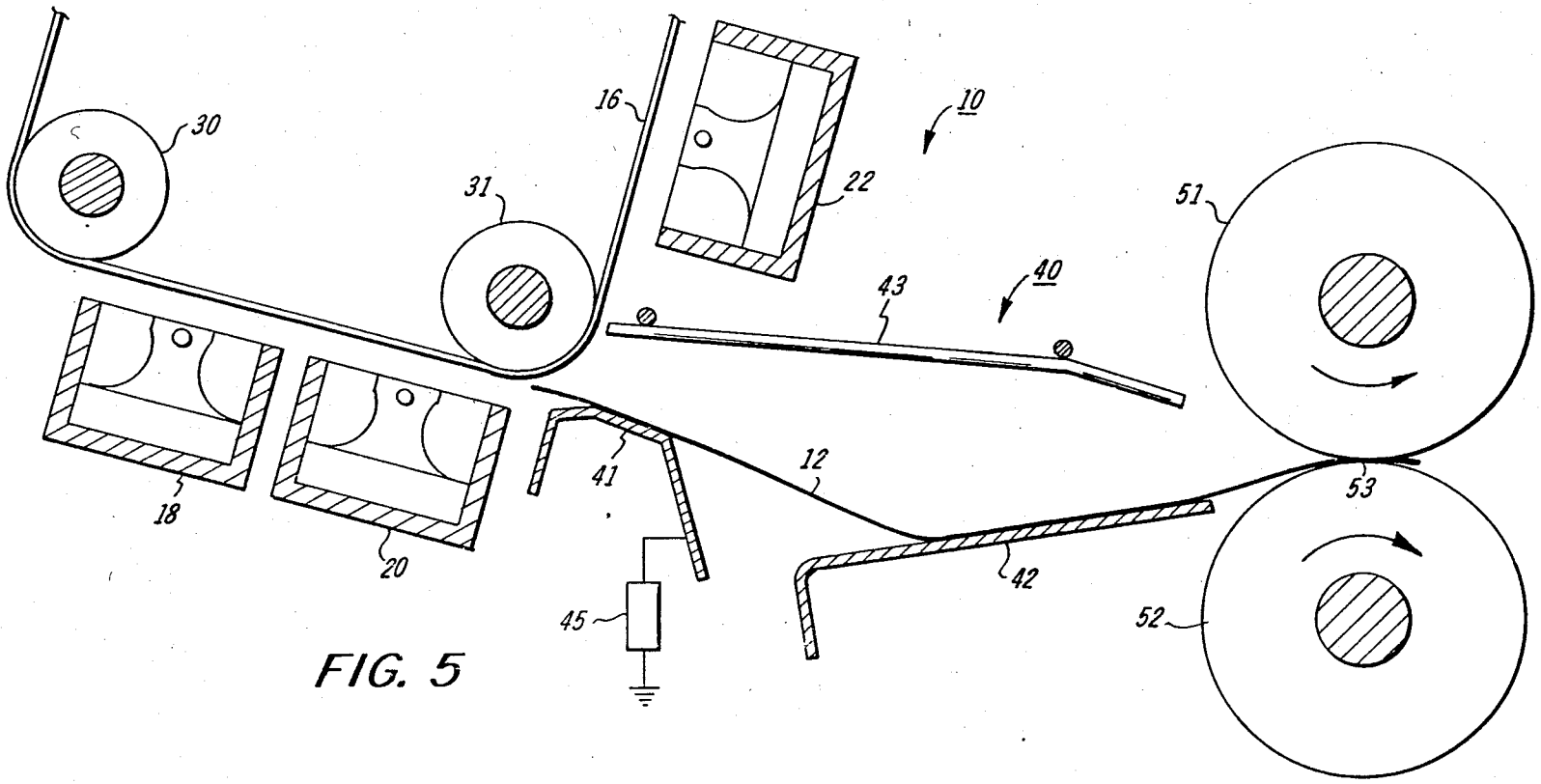

After leaving the passive acquisition baffle, the copy sheet strikes upwardly inclined pre-fuser baffle 42 at an angle of approximately 30° as shown in dotted lines in FIG. 1 and by copy sheet 12 in FIG. 4. Pre-fuser baffle 42 is made from a carbon steel sheet with a polished electroless nickel plate and has a thickness of about 1.5 mm. Continued driving of the copy sheet by the photoreceptor belt causes it to buckle in the chamber formed by passive baffle 41, pre-fuser baffle 42 and paper guide 43 as more clearly shown in FIG. 5. Paper guide 43 is preferably in wire form with very little solid area so that it does not attract the paper. It also serves as a redundant stripper to prevent paper jams. The 15° tilt away from the horizontal of the photoreceptor belt, the configuration of the top surface of passive baffle 41 that is slanted toward pre-fuser baffle 42, the angling of the pre-fuser baffle upward toward fuser nip 53 and canting the fuser nip by 6° counterclockwise all serve to insure that the copy sheet is buckled toward and along the surface of the pre-fuser baffle thereby insuring that the imaged side of the copy sheet will not be disturbed by paper guide 42 nor will that portion of the image still being fed by the photoreceptor be smudged since the sheet has plenty of room to buckle before resistance is encountered. Fuser rolls 51 and 52 will take control of the copy sheet and transport it toward an output area thereby controlling buckle resistance of the copy sheet and smearing or smudging of the imaged surface of the copy sheet against the photoreceptor. A pre-clean corona generator 22 is shown for preparing residual toner left on the photoreceptor after image transfer for cleaning by a cleaning brush or other conventional cleaning means.

A low cost, highly efficient means for transporting copy sheets from a transfer station to a fuser station in a copier or printer is disclosed that makes far more compact machine architectures and faster first copy out times because the distance from the photoreceptor strip point to the fuser is much less than the length of a copy sheet. This short paper path is enabled by a flexible photoreceptor belt and incorporates high electrostatic tacking forces between the copy sheet and the photoreceptor in the transfer zone due to the transfer field acting over a large area. This drives the copy sheet to the fuser. The highly efficient transport means of the instant invention comprises a baffle configuration that allows a concaved buckle to develop in the copy sheet prior to the copy sheet entering the fuser. The buckle is used to absorb the speed mismatch between the photoreceptor and the fuser. While the apparatus and steps disclosed herein are preferred, it will be appreciated that numerous variations and improvements may be made without significantly departing from the scope of the invention by those skilled in the art. The following claims are intended to cover all such variations and improvements as fall within the spirit and scope of the invention.

What is claimed is:

1. In a copying system in which an unfused image is transferred from an initial image support surface moving at a first velocity to a copy sheet while said copy sheet is electrostatically attached to said initial image support surface and moving therewith, and in which a lead area of the transferred unfused image-bearing copy sheet is subsequently engaged by a fusing means spaced from said initial image support surface a distance less than the shortest dimension of said copy sheet and moving at a second velocity while the trail area of the same copy sheet is still moving with the initial image support surface, with the copy sheet extending therebetween, the improvement comprising:

a baffle arrangement positioned between said initial image support surface and said fuser for allowing a concave buckle to develop in said copy sheet prior to entering a nip of said fuser means in order to compensate for the velocity mismatch between said initial image support surface and said fuser means, said baffle arrangement including a grounded passive acquisition baffle which aids in stripping said copy sheet from said initial image support surface through electrostatically attracting said copy sheet to said passive acquisition baffle, and pre-fuser baffle means positioned at an acute angle with respect to a line drawn through the nip of said fuser means, whereby copy sheets leaving said initial image support surface strike said pre-fuser baffle and then buckle up into the nip of said fuser means.

2. The improvement of claim 1, wherein said passive acquisition baffle is configured to direct copy sheets passing thereof such that they initially strike said pre-fuser baffle at an acute angle and subsequently slide up said pre-fuser baffle to form said concaved buckle.

3. The improvement of claim 2, wherein said acute angle is about 30°.

4. The improvement of claim 3, wherein said fuser nip is titled 6° counterclockwise with respect to a line drawn through the center thereof to insure that copy sheets always develop a concave buckle regardless of the weight of said copy sheets and thereby prevent the unfused image bearing side of said copy sheets from being disturbed by a guide baffle positioned above said passive acquisition baffle and said pre-fuser baffle.

5. The improvement of claim 4, wherein said initial image support surface is a photoreceptor belt rotatably mounted around a stripping roll that is positioned downstream from a transfer area, and wherein a first surface of said passive acquisition baffle is located 2 mm below a line drawn tangent to said stripper roll along the direction of travel of said copy sheets.

6. The improvement of claim 5, wherein said stripper roll has a diameter of 0.75" and said passive acquisition baffle has a second surface having a curvilinear profile matching the curvilinear surface of said stripper roll and positioned a distance of about 7 mm from said stripper roll.

7. The improvement of claim 6, wherein said initial image support surface is positioned at an angle of 15° with respect to a line drawn horizontal and tangent to said stripper roll to enhance stripping of copy sheets from said initial image support surface.

8. The improvement of claim 1, including impedance means connected between said passive acquisition baffle and ground to prevent current leakage from a transfer means.

9. In a copying system in which an unfused image is transferred from an initial image support surface moving at a first velocity to a copy sheet while said copy sheet is electrostatically attached to said initial image support surface and moving therewith, and in which a lead area of the transferred unfused image-bearing copy sheet is subsequently engaged by a fusing means spaced from said initial image support surface a distance less than the shortest dimension of said copy sheet and moving at a second velocity while the trail area of the same copy sheet is still moving with the initial image support surface, with the copy sheet extending therebetween, the improvement comprising:

a baffle arrangement positioned between said initial image support surface and said fuser for allowing a concave buckle to develop in said copy sheet prior to entering a nip of said fuser means in order to compensate for the velocity mismatch between said initial image support surface and said fuser means, said baffle arrangement including a dielectric passive acquisition baffle which aids in stripping said copy sheet from said initial image support surface through electrostatically attracting said copy sheet to said passive acquisition baffle, and pre-fuser baffle means positioned at an acute angle with respect to a line drawn through the nip of said fuser means, whereby copy sheets leaving said initial image support surface strike said pre-fuser baffle and then buckle up into the nip of said fuser means.

10. The improvement of claim 9, wherein said passive acquisition baffle is configured to direct copy sheets passing thereover such that they initially strike said pre-fuser baffle at an acute angle and subsequently slide up said pre-fuser baffle to form said concaved buckle.

11. The improvement of claim 10, wherein said acute angle is about 30°.

12. A paper transporting path in a printer, characterized in that the transporting path includes an intermediate portion which is bent downward so that said transporting path becomes longer than the distance of a line drawn along a horizontal plane between a photoreceptor and a fixing device, and is shorter than the length of sheets to be fed between said photoreceptor and said fixing device and wherein the feeding speed of said photoreceptor is V1 and the fixing speed is V2 and V1≧V2.

* * * * *